US006582553B2

(12) United States Patent
Jewell et al.

(10) Patent No.: US 6,582,553 B2
(45) Date of Patent: Jun. 24, 2003

(54) HIGH BULK CELLULOSIC FIBERS CROSSLINKED WITH MALIC ACID AND PROCESS FOR MAKING THE SAME

(75) Inventors: Richard A. Jewell, Tacoma, WA (US); Amar N. Neogi, Kenmore, WA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/886,821

(22) Filed: Jun. 21, 2001

(65) Prior Publication Data

US 2002/0096287 A1 Jul. 25, 2002

Related U.S. Application Data

(63) Continuation of application No. 08/912,055, filed on Aug. 18, 1997, now Pat. No. 6,306,251, which is a continuation of application No. 08/584,595, filed on Jan. 11, 1996, now abandoned, which is a continuation of application No. 08/218,490, filed on Mar. 25, 1994, now abandoned.

(51) Int. Cl.[7] ..... D21H 11/20; D21C 9/00

(52) U.S. Cl. ..... 162/9; 162/157.6; 8/116.1; 8/115.56

(58) Field of Search ..... 162/9, 157.1, 157.2, 162/157.6, 158, 157.4, 168.1, 182, 100; 8/115.51, 115.56, 116.1, 120, 129, 115.7

(56) References Cited

U.S. PATENT DOCUMENTS

| | | | | | |
|---|---|---|---|---|---|
| 2,759,787 | A | * | 8/1956 | Touey et al. | 8/120 |
| 3,395,708 | A | | 8/1968 | Hervey et al. | |
| 3,440,135 | A | | 4/1969 | Chung | |
| 3,526,048 | A | * | 9/1970 | Rowland et al. | 8/120 |
| 3,554,862 | A | | 1/1971 | Hervey et al. | |
| 3,658,613 | A | | 4/1972 | Steiger | |
| 3,677,886 | A | | 7/1972 | Forsblad et al. | |
| 3,819,470 | A | | 6/1974 | Shaw et al. | |
| 3,838,077 | A | | 9/1974 | Hoftiezer et al. | |
| 3,871,817 | A | * | 3/1975 | Harper, Jr. et al. | 8/496 |
| 4,035,147 | A | | 7/1977 | Sangenis et al. | |
| 4,124,439 | A | | 11/1978 | Dessauer | |
| 4,144,122 | A | | 3/1979 | Emanuelsson et al. | |
| 4,303,471 | A | | 12/1981 | Laursen | |
| 4,351,699 | A | | 9/1982 | Osborn, III | |
| 4,431,481 | A | | 2/1984 | Drach | |
| 4,476,323 | A | | 10/1984 | Hellsten et al. | |
| 4,748,076 | A | | 5/1988 | Saotome | |
| 4,820,307 | A | * | 4/1989 | Welch et al. | 8/120 |
| 4,822,453 | A | | 4/1989 | Dean et al. | |
| 4,853,086 | A | | 8/1989 | Graef | |
| 4,889,595 | A | | 12/1989 | Herron et al. | |
| 4,889,597 | A | | 12/1989 | Bourbon et al. | |
| 4,913,773 | A | | 4/1990 | Knudsen et al. | |
| 4,935,022 | A | | 6/1990 | Lash et al. | |
| 5,137,537 | A | * | 8/1992 | Herron et al. | 8/120 |
| 5,217,445 | A | | 6/1993 | Young et al. | |
| 5,225,047 | A | | 7/1993 | Graef et al. | |
| 5,256,746 | A | | 10/1993 | Blankenship et al. | |
| 5,308,896 | A | | 5/1994 | Hansen et al. | |
| 5,906,894 | A | * | 5/1999 | West et al. | 428/507 |
| 6,300,259 | B1 | * | 9/2001 | Westland et al. | 442/153 |
| 2002/0031971 | A1 | * | 3/2002 | Westland et al. | 442/415 |
| 2002/0090511 | A1 | * | 7/2002 | Smith et al. | 428/392 |
| 2002/0112296 | A1 | * | 8/2002 | Graef et al. | 8/115.51 |

FOREIGN PATENT DOCUMENTS

| | | | |
|---|---|---|---|
| EP | 0 440 472 | | 1/1991 |
| EP | 0 429 112 | | 5/1991 |
| EP | 0 429 112 | A2 * | 5/1991 |
| EP | 0 440 472 | A1 * | 8/1991 |
| FR | 2234422 | | 6/1974 |

OTHER PUBLICATIONS

Welch et al. "Malic Acid as a nonformaldehyde DP finishing agent activated by BTCA and polymer additives," TEKTRAN ARS Aug. 19, 1996.*

Kim et al., "Durable Press Finish of Cotton Fabric Using Malic Acid as a Crosslinker," Fibers and Polymers, pp. 1–7, Sep. 27, 2000.*

Blanchard, E.J., et al., "Dyeable Cross–Linked Cellulose from Low Formaldehyde and Non–Formaldehyde Finishing Systems," *Industrial and Engineering Chemistry*, vol. 33, No. 4, pp. 1030–1034, 1994.

Blanchard, E.J., et al., "Dyeable Durable Press Cottons Finished with Citric Acid and Nitrogenous Additives," International Conference, American Association of Textile Chemists and Colorists, 1992.

Carter, M.E., "Chemical Modification via Crosslinking Reactions," Essential Fiber Chemistry, Marcel Dekker, New York, 1991, pp. 8–18.

Carter, M.E., "Dyeing," Essential Fiber Chemistry, Marcel Dekker, New York, 1991, pp. 18–21.

Carter, M.E., "Other Finished Treatments," Essential Fiber Chemistry, Marcel Dekker, 1991.

"HBA—Weyerhaeuser Paper Company Introduces High Bulk Additive," brochure available from Weyerhaeuser Company, Tacoma, WA, 1990.

Neogi, A.N., et al., "Wet Strength Improvement via Fiber Surface Modification," *Tappi*, vol. 63, No. 8, Aug. 1980, pp. 86–88.

Yang, Charles Q., "Infrared Spectroscopy Studies of the Cyclic Anhydride as the Intermediate for the Ester Crosslinking of Cotton Cellulose by Polycarboxylic Acids. I. Identification of the Cyclic Anhydride Intermediate," *Journal of Polymer Science: Part A: Polymer Chemistry*, vol. 31, 1993, pp. 1187–1193.

* cited by examiner

*Primary Examiner*—Jose' A. Fortuna

(57) ABSTRACT

A multi-ply paperboard comprising at least one ply of conventional cellulose fibers and from about 0.1 to about 6 weight percent of a water-borne binding agent; and at least one ply of chemically intrafiber crosslinked cellulosic high-bulk fibers and from about 0.1 to about 6 weight percent of a water-borne binding agent. The water-borne binding agent may be a starch, a modified starch, a polyvinyl alcohol, a polyvinyl acetate, a polyethylene/acrylic acid copolymer, an acrylic acid polymer, a polyacrylate, a polyacrylamide, a polyamine, guar gum, an oxidized polyethylene, a polyvinyl chloride, a polyvinyl chloride/acrylic acid copolymer, an acrylonitrile/butadiene/styrene copolymer or polyacrylonitrile. A method for making the paperboard is disclosed.

11 Claims, 5 Drawing Sheets

HIGH BULK CELLULOSIC FIBERS CROSSLINKED WITH MALIC ACID AND PROCESS FOR MAKING THE SAME

CROSS-REFERENCE TO RELATED APPLICATIONS

This application is a continuation of U.S. patent application Ser. No. 08/912,055, filed Aug. 18, 1997, now U.S. Pat. No. 6,306,251 which is continuation of U.S. patent application Ser. No. 08/584,595, filed Jan. 11, 1996, now abandoned which is a continuation of Ser. No. 08/218,490, filed Mar. 25, 1994, now abandoned, the benefit of the priority of the filing dates of which is hereby claimed under 35 U.S.C. §120.

FIELD OF THE INVENTION

This invention concerns multi-ply cellulosic products and a method for making such products using a composition comprising chemically crosslinked cellulosic fibers and water-borne binding agents.

BACKGROUND OF THE INVENTION

Products made from cellulosic fibers are an attractive alternative because they are biodegradable, are made from a renewable resource, and can be recycled. The main drawback is that the typical cellulosic product has a relatively high density or low bulk. Bulk is the reciprocal of density and is the volume occupied by a specific weight of material and is designated in $cm^3/gm$. The amount of cellulosic material required to provide the requisite strength creates a heavy product. It has poor heat insulating qualities.

A 1990 brochure from Weyerhaeuser Company described a chemically crosslinked cellulosic fiber known as High Bulk Additive or HBA and uses of HBA in filter paper, saturation papers, tissue and toweling, paperboard, paper, and absorbent products. The brochure indicated the HBA fibers may be incorporated into paperboard at levels of 5% and 15%. The brochure also indicates that HBA can be used in the center ply of a three-ply paperboard. The board was compared with a conventional three-ply board. The basis weight was reduced 25%; the Taber stiffness remained constant; but the breaking load was reduced from 25 kN/m to 16 kN/m in the machine direction and from 9 kN/m to 6 kN/m in the cross direction.

Knudsen et al. in U.S. Pat. No. 4,913,773 describe a product that has increased stiffness without an increase in basis weight. It is a three-ply paperboard mat. The middle ply is of anfractuous fibers. The two exterior plies are of conventional fibers. This structure, containing a middle ply of all anfractuous fibers, is compared with single-ply mats of conventional and anfractuous fibers and double- and triple-ply constructions of different conventional fibers. Although in the comparison the middle ply is all anfractuous fibers, Knudsen et al. also propose constructions in which the middle ply combines conventional and anfractuous fibers. In this latter construction Knudsen et al. require at least 10% by weight of anfractuous fibers in the center ply in order to obtain the necessary stiffness.

Knudsen et al. obtain the anfractuous fibers by mechanical treatment, by chemical treatment with ammonia or caustic, or by a combination of mechanical and chemical treatment. The treatment proposed by Knudsen et al. does not provide intrafiber crosslinking, using 1 weight percent starch to obtain adequate bonding of the plies. Knudsen et al. may use bonding agents with certain multi-ply constructions.

Kokko European Patent No. 0 440 472 discusses high-bulk fibers. The fibers are made by chemically crosslinking wood pulp using polycarboxylic acids. Kokko is directed to an individualized crosslinked fiber, and single-ply absorbent and high-bulk paper products made from this fiber.

Kokko used a blend of 75% untreated fibers and 25% treated fibers. The maximum dry bulk achieved by Kokko was 5.2 $cm^3/gm$ using 25% citric acid treated fibers and 5.5 $cm^3/gm$ using 25% citric acid/monosodium phosphate treated fibers.

Kokko also states that polycarboxylic acid crosslinked fibers should be more receptive to cationic additives important to papermaking and that the strength of sheets made from the crosslinked fibers should be recoverable without compromising the bulk enhancement by incorporation of a cationic wet-strength resin. There is no indication that Kokko actually tried cationic strength additives, or any other strength additives, with the crosslinked fibers. Consequently, Kokko did not describe the amount of cationic additive that might be used or the result of using the additive.

Treating anionic fibers, such as Kokko describes, with a cationic additive substantially completely coats the entire surface of the fiber with additive. This is noted by Kokko in the experiment with methylene blue dye. The cationic additive is attracted to the entire surface of the anionic fiber. More additive is used than is needed to provide binder at the fiber-to-fiber contact points because the entire fiber is coated.

Young et al. in U.S. Pat. No. 5,217,445 disclose an acquisition/distribution zone of a diaper. It comprises 50 to 100% by weight of chemically stiffened cellulosic fibers and 0 to 50% by weight of a binding means. The binding means may be other nonstiffened cellulosic material, synthetic fibers, chemical additives and thermoplastic fibers. The material has a dry density less than about 0.30 $gm/cm^3$, a bulk of 3.33 $cm^3/gm$.

SUMMARY OF THE INVENTION

The addition of suitable water-borne binding agents to intrafiber crosslinked cellulosic fiber and incorporating this material into one or more plies of a multi-ply structure produce a material that has a relatively high bulk and relatively high physical strength. It also produces a material that requires less fiber (i.e., lower basis weight product), compared to conventional fiber, to produce the desired strength. One of the plies of a two-ply paperboard construction, the center ply of a three-ply paperboard construction, or the middle plies of a multi-ply paperboard construction having more than three plies, uses a high-bulk fiber/water-borne binding agent composition.

The high-bulk fiber is an intrafiber chemically crosslinked cellulosic material that may be formed into a mat having a bulk of from about 1 $cm^3/g$ to about 50 $cm^3/g$. The bulk of mats formed from such fibers typically is greater than about 5 $cm^3/g$. Suitable crosslinking agents are generally of the bifunctional type that are capable of bonding with the hydroxyl groups to create covalently bonded bridges between hydroxyl groups on the cellulose molecules within the fiber. The use of a polycarboxylic acid crosslinking agent, such as citric acid, produces a product that is especially suitable for food packaging.

Adding certain weight percents of water-borne agents, such as starch and polyvinyl alcohol, to chemically crosslinked high-bulk fiber produces a composition having physical characteristics superior to high-bulk fibers alone, conventional fibers alone, or mixtures of high-bulk fibers and conventional fibers without such binding agents.

DETAILED DESCRIPTION OF THE PREFERRED EMBODIMENT

Figure 1:
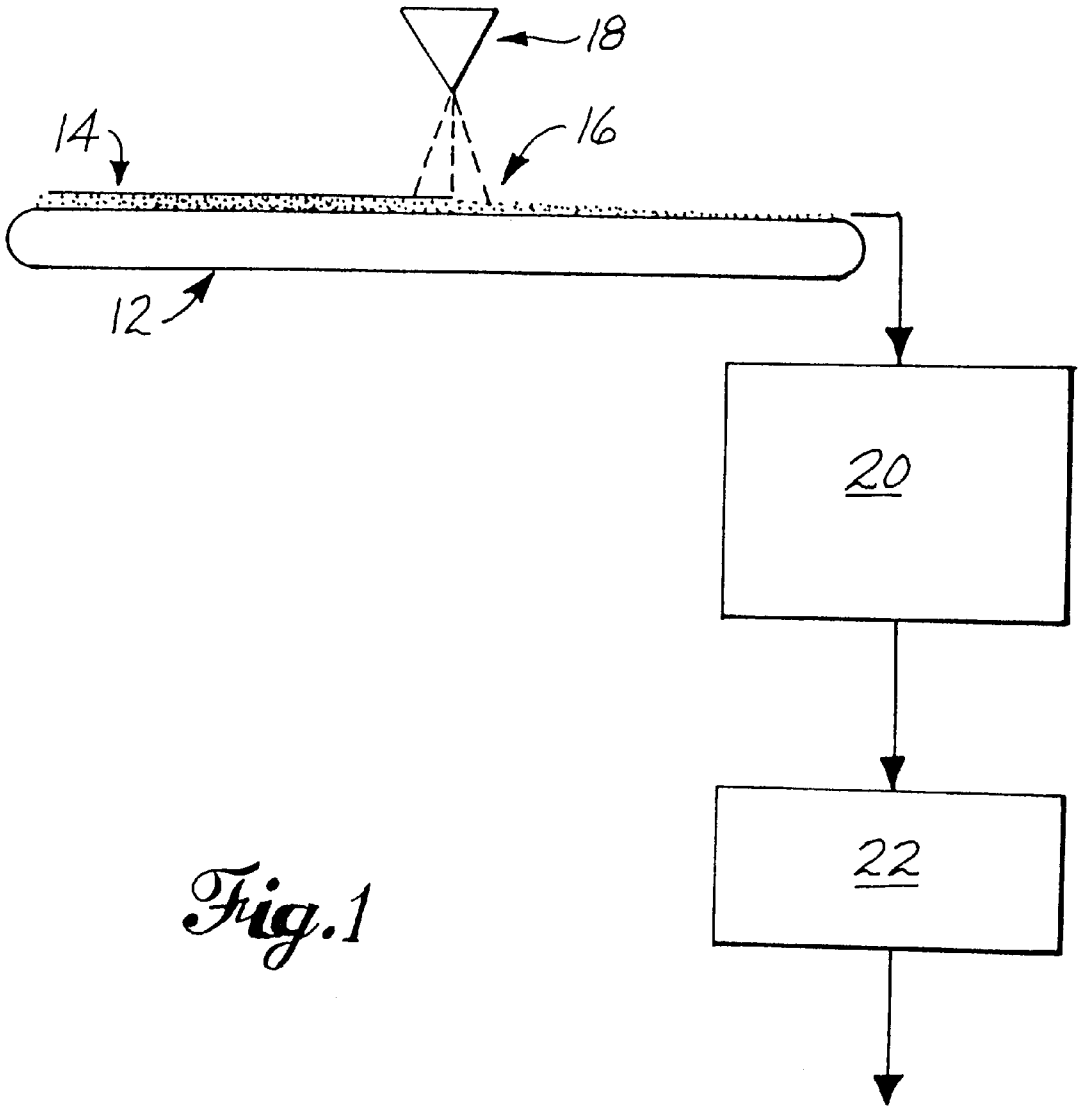
FIG. 1 is a block diagram showing a process for making high-bulk chemically crosslinked fibers.

The present invention provides a composition comprising chemically crosslinked cellulosic fiber and water-borne binding agents. When incorporated into a ply of a multi-ply paperboard construction it is combined with conventional papermaking fiber furnish. Conventional papermaking fiber furnish refers to papermaking fibers made from any species, including hardwoods and softwoods, and to fibers that may have had a debonder applied to them but that are not otherwise chemically treated following the pulping process. They include chemical wood pulp fibers.

The cellulose fiber may be obtained from any source, including cotton, hemp, grasses, cane, husks, cornstalks or other suitable source. Chemical wood pulp is the preferred cellulose fiber.

The high-bulk chemically crosslinked cellulosic fiber is an intrafiber crosslinked cellulosic fiber that may be crosslinked using a variety of suitable crosslinking agents. The individual fibers are each comprised of multiple cellulose molecules and at least a portion of the hydroxyl groups on the cellulose molecules have been bonded to other hydroxyl groups on cellulose molecules in the same fiber by crosslinking reactions with the crosslinking agents. The crosslinked fiber may be formed into a mat having a bulk of from about 1 $cm^3$/gm to about 50 $cm^3$/gm, typically from about 10 $cm^3$/gm to about 30 $cm^3$/gm, and usually from about 15 $cm^3$/gm to about 25 $cm^3$/gm. Suitable crosslinking agents are generally of the bifunctional type, which are capable of bonding with the hydroxyl groups, and create covalently bonded bridges between hydroxyl groups on the cellulose molecules within the fiber. Preferred types of crosslinking agents are polycarboxylic acids or selected from urea derivatives such as methylolated urea, methylolated cyclic ureas, methylolated lower alkyl substituted cyclic ureas, methylolated dihydroxy cyclic ureas. Preferred urea derivative crosslinking agents would be dimethyloldihydroxyethylene urea (DMDHEU), dimethyldihydroxyethylene urea. Mixtures of the urea derivatives may also be used. Preferred polycarboxylic acid crosslinking agents are citric acid, tartaric acid, malic acid, succinic acid, glutaric acid, or citraconic acid. These polycarboxylic crosslinking agents are particularly useful when the proposed use of the paperboard is food packaging. Other polycarboxylic crosslinking agents that may be used are poly(acrylic acid), poly(methacrylic acid), poly(maleic acid), poly(methylvinylether-co-maleate) copolymer, poly (methylvinylether-co-itaconate) copolymer, maleic acid, itaconic acid, and tartrate monosuccinic acid. Mixtures of the polycarboxylic acids may also be used.

Other crosslinking agents are described in Chung U.S. Pat. No. 3,440,135; Lash et al. U.S. Pat. No. 4,935,022; Herron et al. U.S. Pat. No. 4,889,595; Shaw et al. U.S. Pat. No. 3,819,470; Steijer et al. U.S. Pat. No. 3,658,613; Dean et al. U.S. Pat. No. 4,822,453; and Graef et al. U.S. Pat. No. 4,853,086, all of which are in their entirety incorporated herein by reference.

The crosslinking agent can include a catalyst to accelerate the bonding reaction between the crosslinking agent and the cellulose molecule, but most crosslinking agents do not require a catalyst. Suitable catalysts include acidic salts that can be useful when urea-based crosslinking substances are used. Such salts include ammonium chloride, ammonium sulfate, aluminum chloride, magnesium chloride, or mixtures of these or other similar compounds. Alkali metal salts of phosphorus containing acids may also be used.

The crosslinking agent typically is applied in an amount ranging from about 2 kg to about 200 kg chemical per ton of cellulose fiber and preferably about 20 kg to about 100 kg chemical per ton of cellulose fiber.

The cellulosic fibers may have been treated with a debonding agent prior to treatment with the crosslinking agent. Debonding agents tend to minimize interfiber bonds and allow the fibers to separated from each other more easily. The debonding agent may be cationic, nonionic or anionic. Cationic debonding agents appear to be superior to nonionic or anionic debonding agents. The debonding agent typically is added to cellulose fiber stock.

Suitable cationic debonding agents include quaternary ammonium salts. These salts typically have one or two lower alkyl substituents and one or two substituents that are or contain fatty, relatively long-chain hydrocarbon. Nonionic debonding agents typically comprise reaction products of fatty-aliphatic alcohols, fatty-alkyl phenols and fatty-aromatic and aliphatic acids that are reacted with ethylene oxide, propylene oxide, or mixtures of these two materials.

Examples of debonding agents may be found in Hervey et al. U.S. Pat. Nos. 3,395,708 and 3,544,862; Emanuelsson et al. U.S. Pat. No. 4,144,122; Forssblad et al. U.S. Pat. No. 3,677,886; Osborne III U.S. Pat. No. 4,351,699; Hellston et al. U.S. Pat. No. 4,476,323; and Laursen U.S. Pat. No. 4,303,471, all of which are in their entirety incorporated herein by reference. A suitable debonding agent is Berocell 584 from Berol Chemicals, Incorporated of Metairie, La. It may be used at a level of 0.25% weight of debonder to weight of fiber. Again, a debonding agent may not be required.

A high-bulk fiber is available from Weyerhaeuser Company. It is HBA fiber and is available in a number of grades. The suitability of any of the grades will depend upon the end product being manufactured. Some may be more suitable for food grade applications than others. U.S. patent applications Ser. Nos. 07/395,208 and 07/607,268 describe a method and apparatus for manufacturing HBA fibers. These applications are in their entirety incorporated herein by reference.

In essence, a conveyor 12 (FIG. 1) transports a cellulose fiber mat 14 through a fiber treatment zone 16 where an applicator 18 applies a crosslinking agent onto the mat 14. Typically, chemicals are applied uniformly to both sides of the mat. The mat 14 is separated into substantially unbroken individual fibers by a fiberizer 20. Hammermills and disc refiners may be used for fiberization. The fibers are then dried and the crosslinking agent cured in a drying apparatus 22.

The high-bulk fibers produce cellulosic products having poor fiber-to-fiber bond strength. One of the ways of measuring fiber-to-fiber bond strength is tensile index. Tensile index is a measure of a sheet's tensile strength, normalized with respect to the basis weight of the sheet, and provides a measure of the inherent tensile strength of the material. A wet-laid sheet made from the unmodified and unbeaten cellulose fibers from which the HBA is subsequently made has a tensile index of about 1.1 Nm/g, whereas a similar wet-laid sheet made from the chemically crosslinked high-bulk fibers has a tensile index of only about 0.008 Nm/g, a 140-fold decrease. Fibers can readily be removed from pads of the high-bulk material simply by blowing air across the pad.

The composition of the present invention requires a water-borne binding agent. This produces a product that has increased bulk, decreased density, and strength that is substantially the same as products made without high-bulk fiber. The term water-borne means any binding agent capable of being carried in water and includes binding agents that are soluble in, dispersible in, or form a suspension in water. Suitable water-borne binding agents include starch, modified starch, polyvinyl alcohol, polyvinyl acetate, polyethylene/acrylic acid copolymer, acrylic acid polymers, polyacrylate, polyacrylamide, polyamine, guar gum, oxidized polyethylene, polyvinyl chloride, polyvinyl chloride/acrylic acid copolymers, acrylonitrile/butadiene/styrene copolymers and polyacrylonitrile. Many of these will be formed into latex polymers for dispersion or suspension in water. Particularly suitable binding agents include starches, polyvinyl alcohol, and polyvinyl acetate. The purpose of the binding agent is to increase the overall binding of the high-bulk fiber within the sheet.

Various amounts of the water-borne binding agent may be used. The amount of binding agent used may expressed as a loading level. This is the amount of binding agent relative to the dry weight of the fiber and binding agent. Suitable binding agent loading levels are from about 0.1 weight percent to about 6 weight percent, preferably from about 0.25 weight percent to about 5.0 weight percent and most preferably from about 0.5 weight percent to about 4.5 weight percent.

The binding agent may be applied to the high-bulk fiber pad and sucked through the sheet by vacuum. The excess binding agent is removed, as by blotting. The sheets are further dried by drawing 140° C. air through the pads. The treated pads have low density and good stiffness. The pads can be cut easily using a sharp knife. The material strongly resembles expanded polystyrene in appearance and feel.

The material, either alone or mixed with conventional fiber, may be used to form multi-ply paperboard having good thermal resistance.

The amount of high-bulk additive fiber used in one of the plies of a two-ply paperboard sheet or the center ply or plies of a multi-ply paperboard sheet can be up to 20% by weight. It is preferred to use about 5% by weight. Ten percent by weight can be used. No high-bulk additive fiber need be used in the outer plies of a multi-ply sheet but the use of around 5% high-bulk additive fibers in the outer plies may be beneficial. The use of the HBA fiber in any of the plies can speed up the forming, pressing, and drying process and improve calendering in the manufacture of the paperboard, depending on what the limiting steps in the process are.

Figure 4:
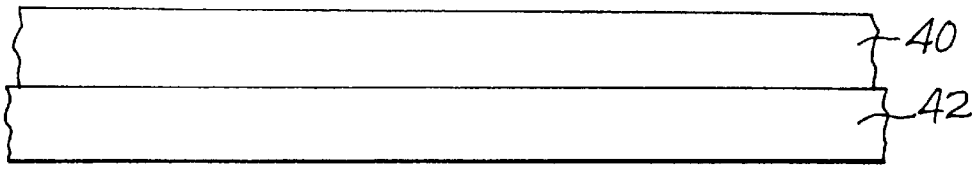
FIGS. 4 and 5 show multi-ply paperboard.
Figure 5:
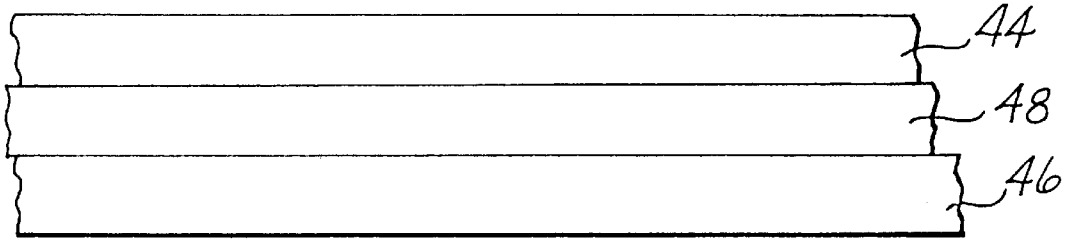

Examples of multi-ply paperboards are shown in FIGS. 4 and 5. FIG. 4 shows a two-ply paperboard in which one of the plies 40 is of conventional pulp fibers or a combination of conventional fibers and up to 5% by weight of high-bulk additive fibers, and the other ply 42 is of high-bulk additive fibers or a combination of high-bulk additive fibers and from about 5% by weight to about 99.5% by weight of conventional pulp fibers. There would be more high-bulk fiber in ply 42 than in ply 40. Both plies would include a binding agent.

FIG. 5 shows a three-ply paperboard in which the outer plies 44 and 46 are of conventional fibers and the center ply 48 is of high-bulk fibers. Again, there may be up to 5% by weight of high-bulk fibers in the outer plies and from 5% by weight to 99.5% by weight of conventional fibers in the center ply. There is a greater weight percent of high-bulk fiber in the center ply than in the other plies. All plies include binding agent.

EXAMPLES

Example 1

Twenty grams of commercially available HBA fiber were dispersed in 9.5 liters of water to form an HBA/water slurry having a consistency of 0.21%. Consistency is the weight of air-dry pulp as a percentage of the pulp/water slurry weight. The slurry was placed in an 8"×8" laboratory handsheet mold. The slurry was dewatered to form a pad, first by suction, then by hand pressing between blotting papers, and finally by drying in an oven at a temperature of 105° C. The resulting cellulosic pad had a density of 0.02 g/cm$^3$, a bulk of 50 cm$^3$/g. The density of commercially available paper typically is in the range of from about 0.5 g/cm$^3$ to about 1 g/cm$^3$, a bulk of from about 2 cm$^3$/g to 1 cm$^3$/g. The density of wet-laid HBA fiber pads is about 25 to 50 times lower than the densities of typical paper sheets, and the bulk is about 50 to 100 times greater than the bulk of typical paper sheets. Fibers could be removed from the HBA fiber pad by blowing air across the sheet.

Example 2

6.5 grams of HBA fiber were dispersed in eight liters of water to provide a cellulose-water slurry having a consistency of about 0.08%. The slurry was formed into pads in a six-inch diameter laboratory handsheet mold. The slurry was dewatered as in Example 1. The resulting pad had a density of 0.025 g/cm$^3$, a bulk of 40 cm$^3$/g.

Tensile indexes for this pad were determined. Tensile indexes for the HBA fiber pad and for a control pad made from NB316, a starting pulp for a commercially available HBA. The results are in Table I.

TABLE I

| Pulp Type | Tensile Index (Nm/g) |
|---|---|
| HBA fiber | 0.0081 |
| NB316 control | 1.15 |

Pads of HBA fiber made by air-laying have a similar low tensile index.

High-bulk additive sheets were prepared as in Example 1. Aqueous solutions of water-borne binding agents were applied to the sheets. The solution typically is vacuum-sucked through the sheet. Excess binding-agent solution is removed from the sheets first by blotting. The sheets are further dried by drawing air through the pads. The air is at a temperature of about 140° C.

Dry pads made using this process have low density and good stiffness. The strength of the sheets was markedly increased relative to high-bulk additive sheets made without the binding agents. The products could be cut easily with a knife. The material strongly resembles expanded polystyrene in appearance and feel.

Example 3

Six-inch diameter pads were formed from high-bulk additive fibers using either an air-laid or a wet-laid process. Either process forms essentially unbonded high-bulk additive pads. The pads were weighed and placed in a six-inch diameter Buchner funnel.

The pads were saturated with aqueous solutions of either starch or polyvinyl alcohol. The starch was HAMACO 277 starch from A. E. Staley Manufacturing Company. This is an essentially nonionic or neutral charge starch. The polyvinyl alcohol was ELVANOL HV from DuPont Chemical Company. The amounts of binding agent in the solutions ranged from about 0.5 weight percent to 5 weight percent of the total weight of the solution.

The pads were removed from the Buchner funnel and supported between sheets of synthetic nonwoven. A suitable nonwoven is James River 0.5 oz/yd$^2$ Cerex 23 nonwoven. The supported pad was squeezed between blotting papers to remove excess liquid from the saturated sheets. The pads were then dried by passing hot air, at about 140° C., through the pads using a laboratory thermobonder. Binder loading levels of from about 2.5 to about 5% of the weight of the fiber in the pad have been obtained using this process. Binder loading levels typically are about 3 to about 4.5% of the weight of the fiber in the pad.

Pulp densities and tensile indexes were determined as in Example 2. NB316 pulp with and without binder and HBA fibers without binder were used as controls. The samples and results are given in Table II. It will be noted that most of the binder-treated HBA fiber pads have a tensile index equal to or greater than the 1.15 Nm/g tensile index of NB316 without binder even though the densities of the HBA pads were less than one-half the 0.220 g/cm$^3$ density of the NB316 pad. It was noted that polyvinyl alcohol greatly increased the tensile index of HBA fiber pads. Polyvinyl alcohol bonded HBA fiber pads had a density of one-third that of starch-bonded NB316 fibers but had a tensile index that almost equaled that of the starch-bonded NB316. The density of another sample of polyvinyl alcohol bonded HBA fiber pads was less than one-half the density of the starch-bonded NB316 but its tensile index was more than twice that of the starch-bonded NB316.

It can also be seen in Table II that a starch-bonded blend of HBA fibers and conventional pulp fibers can provide a product that has a low density and a tensile index that is almost the same as conventional pulp fiber alone.

Figure 2:
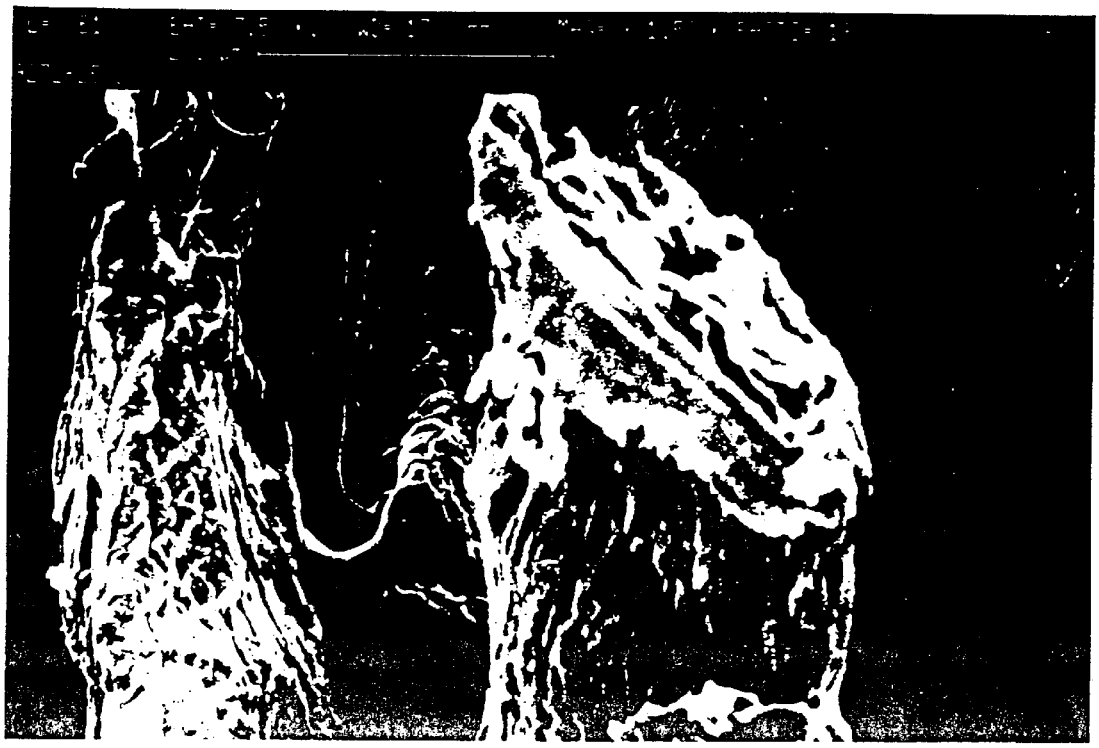
FIG. 2 is a scanning electron micrograph (SEM) of a High Bulk Additive (HBA) fiber/water-borne binding agent composition made according to this invention.

FIG. 2 is an electron-microscope micrograph of an HBA/water-borne binding agent composition produced according to Example 4. FIG. 2 shows that the water-borne binding agent substantially completely collects at the crossover or contact points between fibers where it is seen as a bridge between them. Without limiting the invention to one theory of operation, it is believed that the polymer collects or concentrates at the crossover or contact points primarily by capillary action. The majority of the binding agent is located where it is needed.

Example 4

Six-inch diameter air-laid HBA fiber pads were weighed and placed in a six-inch diameter Buchner funnel. Aqueous solutions were prepared of a polyvinyl acetate latex polymer, Reichold PVAc latex 40–800, at concentrations of polymer of 2% and 5% of the total weight of the solution. The solutions were passed through the pads in the funnels. The pads were dried in the same manner as the pads in Example 4. The loading levels of the polymeric binder were from about 2 weight percent to about 4 weight percent. The resultant pads were well bonded.

Example 5

9.95 grams of a 10/90 weight ratio blend of chemically crosslinked high-bulk fiber and NB316 conventional pulp were dispersed in 9.5 liters of water. The water contained 0.8 weight percent water-soluble cationic potato starch, D.S. 0.3 Accosize 80 starch. The cellulosic dispersion was placed in an 8"×8" handsheet mold to produce a pad having a basis-weight of about 240 g/m$^2$. Excess moisture was removed from the pad by pressing between blotter papers, and the pad was dried in a fan oven at 105° C.

The dry pad was tested for density, Taber stiffness and thermal resistance. The same values were obtained for expanded polystyrene from the lid of a clamshell packaging box used by McDonald's Corporation. The cost of material per unit area in the cellulosic pad and in the polystyrene lid were substantially equal. The results of the tests are given in Table III.

TABLE II

| Fiber Type | Bonding Agent | Solution Strength % of Solution Weight | Loading Level % of Pulp Weight | Pad Density g/cm$^3$ | Pad Bulk cm$^3$/g | Tensile Index Nm/g |
|---|---|---|---|---|---|---|
| NB316 wet laid | None | N/A | N/A | 0.220 | 4.55 | 1.15 |
| NB316 wet laid | Starch HAMACO 277 | 2 | 7.5 | 0.240 | 4.17 | 1.92 |
| HBA wet laid | None | N/A | N/A | 0.025 | 40 | 0.0081 |
| HBA air laid | Starch HAMACO 277 | 5 | 4.1 | 0.108 | 9.26 | 1.504 |
| HBA air laid | Starch HAMACO 277 | 2 | 3.8 | 0.073 | 13.7 | 1.127 |
| HBA air laid | Starch HAMACO 277 | 0.5 | 3.2 | 0.043 | 23.26 | 0.413 |
| HBA air laid | Polyvinyl alcohol Elvanol 52-22 | 5 | 2.9 | 0.077 | 12.99 | 1.82 |
| HBA air laid | Polyvinyl alcohol Elvanol HV | 5 | 3.8 | 0.100 | 10 | 4.71 |
| 25% HBA/75% NB316 blend by weight-air laid | Starch HAMACO 277 | 2 | 4.4 | 0.106 | 9.43 | 1.189 |

TABLE III

| Material | Basis Weight, g | Caliper, mm | Density, g/cm$^3$ | Bulk, cm$^3$/g | Starch Loading, % Weight on Fiber | Taber Stiffness, (sd) | Thermal Resistance, mK/W |
|---|---|---|---|---|---|---|---|
| Blend, 10% HBA/90% NB316 by weight | 240 | 1.5 | 0.16 | 6.25 | 3.2 | 123 (10) | 0.049 |
| Styrofoam | 120 | 1.0 | 0.12 | 8.33 | N/A | 88–128* | 0.035 |

*stiffness of Styrofoam varies with the direction relative to the forming process. The fiber blend compared favorably with the Styrofoam material.

Example 6

Figure 3:
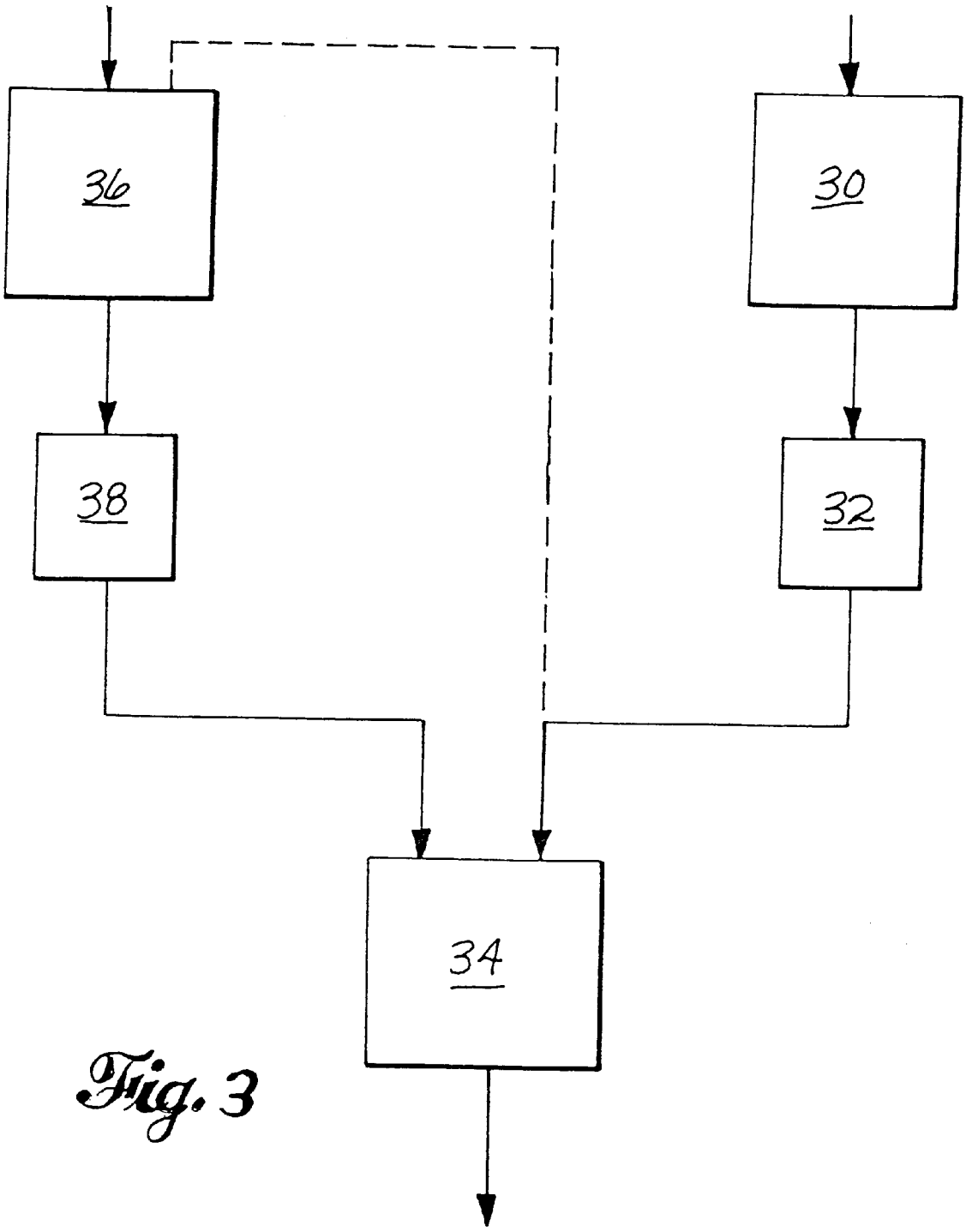
FIG. 3 is a block diagram showing how the midply fraction containing HBA is produced according to the present invention.

The HBA fiber was substituted for 10% by weight of the conventional midply furnish in a three-ply paperboard structure. The process is shown schematically in FIG. 3. The manufacture of 100 parts by weight of midply fiber at high consistency is illustrated. High consistency is, in this process, a consistency above 2% by weight fiber in the furnish. In the present example the furnish is 3% by weight.

Eighty parts by weight of conventional fiber, here Douglas fir (DF) is combined with water in hydropulper 30 to form a 3% by weight consistency furnish. The furnish is passed from hydropulper 30 to refiner 32 where it is refined or beaten to fibrillate the fiber surface and enhance fiber-to-fiber bonding in the dry sheet. The fiber leaving the refiner was at a Canadian Standard Freeness (CSF) of about 560. The refined fiber was carried to midply stock chest 34.

HBA fibers tend to flocculate in an aqueous suspension, forming loose fiber clumps and agglomerations. The HBA may also contain nits or knots. The nits and knots, as well as the clumps and agglomerations, can cause lumps in the paperboard. The clumps and agglomerations can be reduced by combining the HBA fibers with conventional fibers and dispersing the mixture in water. The amount of conventional fiber may be from 10% by weight to 90% by weight. In the example, ten parts by weight of HBA fiber are combined with ten parts by weight of conventional DF fiber and added to water in a hydropulper 36 to form a 3% by weight consistency furnish. The conventional fiber may be either refined or unrefined fiber.

Any nits or knots, and remaining clumps or agglomerations are removed by passing the slurry from hydropulper 36 through a deflaker 38.

HBA fiber should not be refined because refining fractures the fiber, reducing its length and its ability to provide bulk in a product. The 20 parts by weight HBA fiber/conventional fiber combination from hydropulper 36 are combined with the 80 parts by weight conventional fiber furnish from hydropulper 30 after the refiner 32, as shown schematically in FIG. 3. It is shown being combined at the stock chest 34.

Example 7

The fiber furnish of Example 6 was used to prepare the midply of a three-ply paperboard. The midply was formed using a high-consistency forming headbox. The purpose of the experiment was to determine whether chemically modified high-bulk fiber could be used in a high-consistency system, whether it would provide bulk in the final product when used in a high-consistency system, and whether the paperboard would be formed and would have acceptable internal bond strength.

The water-borne binding agent is added to each of the plies either at the stock chest or between the stock chest and the headbox.

Three conditions were studied. A control three-ply paperboard had no HBA fibers and used a conventional starch loading of 15 pounds of starch/Air Dry Ton (ADT) of pulp. The HBA fibers were studied at two starch levels. The first was at a starch loading of 15 pounds of starch/ADT of pulp; the second was at a starch loading of 30 pounds of starch/ADT of pulp. The starch loading was the same in all three plies. In each case the starch was a cold-water soluble cationic starch, Roquette High Cat. CSW 042 cationic potato starch (DS 0.37 to 0.38). The paperboard was formed, dried on a conventional can-dryer, and thereafter calendered to obtain a constant smoothness. The results are shown in Table IV.

TABLE IV

| Property | 3-ply Paperboard | 3-ply Paperboard | 3-ply Paperboard |
|---|---|---|---|
| HBA in center ply % by weight of total pulp fiber in center ply | 0 | 10 | 10 |
| Starch loading level lbs/air dry ton pulp | 15 | 15 | 30 |
| Overall Basis Weight (g/m$^2$) | 316.2 (1.077) | 295.0 (1.400) | 285.0 (1.861) |
| % reduction in basis weight vs. control | N/A | 6.7 | 9.9 |
| Caliper (mm) | 0.452 (0.002) | 0.457 (0.002) | 0.441 (0.003) |
| Density kg/m$^3$ | 699.0 (33.3) | 645.4 (9.6) | 645.7 (18.8) |
| Parker Print Surface 20s Microns | 5.478 (0.575) | 5.446 (0.269) | 5.796 (0.311) |
| Scott Bond J/m$^2$ | 285.9 (44.8) | 262.4 (21.1) | 323.7 (15.6) |
| Mullen kPa | 985.7 (154) | 964.5 (69.8) | 980.7 (72.5) |
| Tensile kN/m | 22.1 (0.83) | 21.3 (1.03) | 22.5 (1.52) |

The numbers in parenthesis are the standard deviation.

As can be seen, the basis weight of the board can be significantly reduced without impacting the board's physical properties such as caliper, internal bond strength, printability, mullen, and tensile.

Example 8

Figure 6:
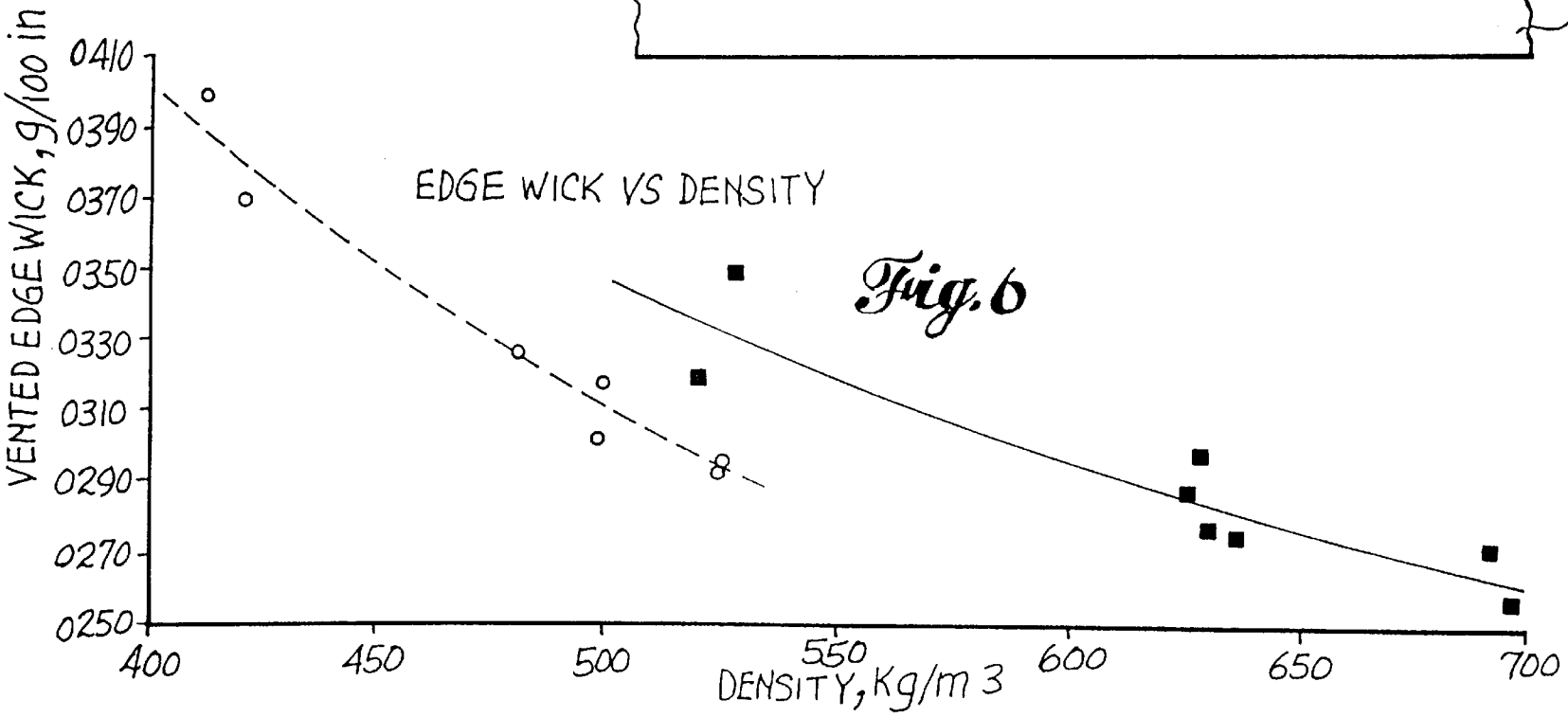
FIG. 6 is a graph of edge wicking versus density and shows the decrease in absorbency when high-bulk fibers are included in the furnish.

The edge wicking of sheets of conventional fibers and sheets of a mixture of conventional fibers and high-bulk additive fibers were compared. Tappi handsheets were prepared. They contained 10 pounds of starch per air dry ton of fiber and 5 pounds of Kymene per air dry ton of fiber. Two fiber furnishes were used. The first furnish contained conventional pulp fiber. The second contained 90% by weight conventional pulp fiber and 10% by weight high-bulk additive fiber. The wet hand sheets were pressed to different densities and compared for edge wicking. The sheets were weighed and the edges of the sheets placed in a liquid for a specified period of time. The sheets were weighed again. Wicking is expressed as grams of liquid absorbed per 100 inches of edge. The results are shown in FIG. 6. At a given density the conventional fiber absorbed more liquid than the conventional fiber/high-bulk additive fiber mixture. The conventional fiber is shown in a bold line and the conventional fiber/high-bulk additive mixture is shown in dotted lines.

Example 9

Figure 7:
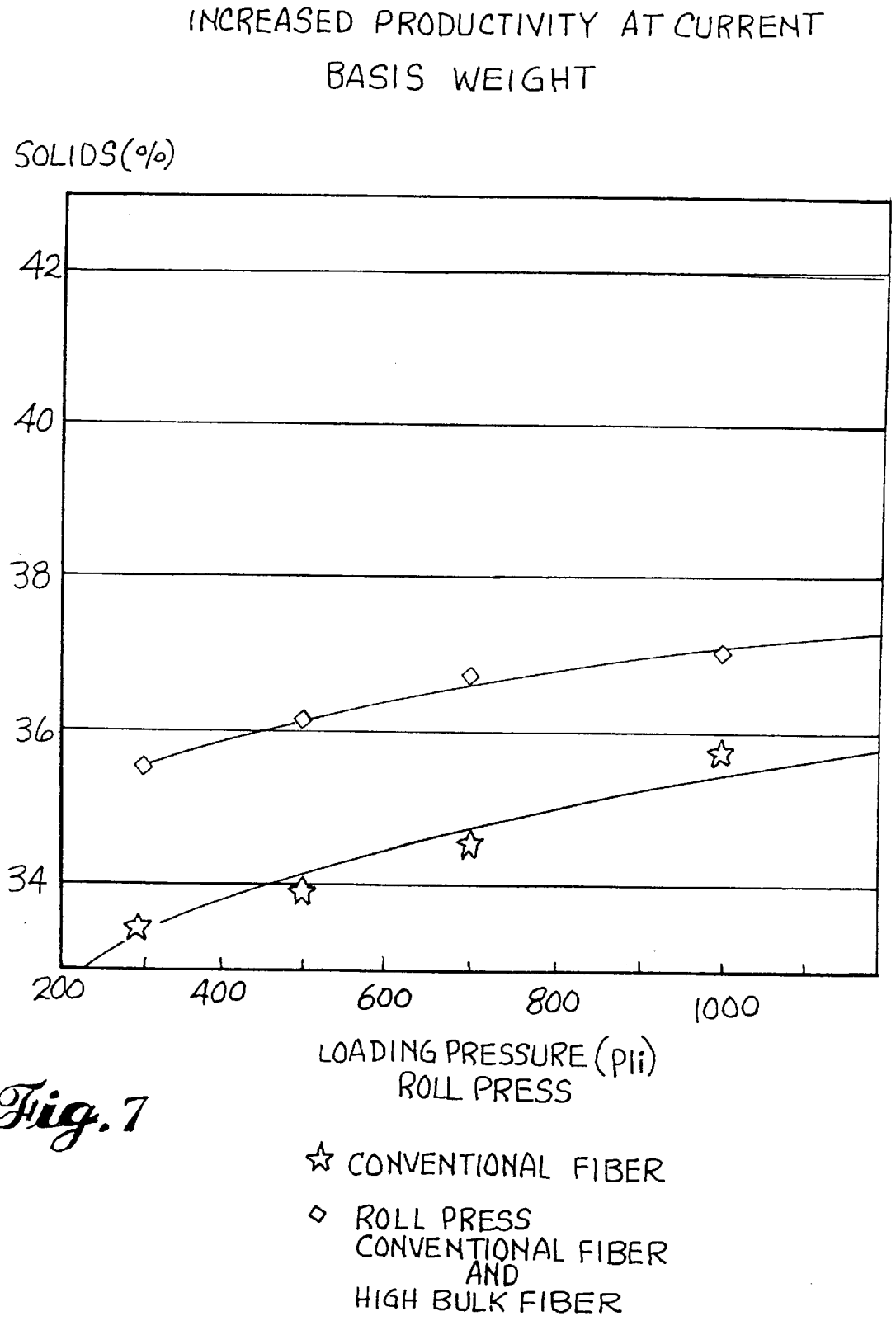
FIG. 7 is a graph of solids versus loading pressure and shows the increase in productivity at current basis weight.

The solids level of sheets of conventional fibers and a mixture of conventional fibers and high-bulk additive fibers after wet pressing were compared. Two pulp furnishes were used. The first pulp contained conventional pulp fiber. The second contained 90% by weight conventional pulp fiber and 10% by weight high-bulk additive fiber. Wet handsheets were roll pressed at different loading pressures and the solids levels in the sheets after pressing were determined on a weight percent. The results are shown in FIG. 7. The sheets of a mixture of conventional fibers and high-bulk additive fibers had a higher solids level, i.e., they were drier after pressing than the conventional fiber sheets.

It will be apparent to those skilled in the art that the specification and examples are exemplary only and the scope of the invention is embodied in the following claims.

The embodiments of the invention in which an exclusive property or privilege is claimed are defined as follows:

1. Individualized, chemically crosslinked high-bulk cellulosic fibers comprising cellulosic fibers chemically intrafiber crosslinked with malic acid.

2. The fibers of claim 1, wherein malic acid is applied to the fibers in an amount from about 2 kg to about 200 kg per ton of fiber.

3. The fibers of claim 1, wherein malic acid is applied to the fibers in an amount from about 20 kg to about 100 kg per ton of fiber.

4. The fibers of claim 1, wherein the cellulosic fibers are wood pulp fibers.

5. A method for forming individualized, chemically intrafiber crosslinked high-bulk cellulosic fibers comprising the steps of:

applying malic acid to a mat of cellulosic fibers;

separating the mat into substantially unbroken individualized fibers; and curing the malic acid to form intrafiber crosslinks.

6. The method of claim 5, wherein malic acid is applied to the fibers in an amount from about 2 kg to about 200 kg per ton of fiber.

7. The method of claim 5, wherein malic acid is applied to the fibers in an amount from about 20 kg to about 100 kg per ton of fiber.

8. The method of claim 5, wherein the cellulosic fibers are wood pulp fibers.

9. The method of claim 5, further comprising the step of applying a crosslinking catalyst to the mat of cellulosic fibers.

10. The method of claim 9, wherein the crosslinking catalyst is an alkali metal salt of a phosphorous containing acid.

11. The method of claim 9, wherein the crosslinking catalyst is at least one of ammonium chloride, ammonium sulfate, aluminum chloride, and magnesium chloride.

* * * * *